US011191410B2

(12) United States Patent
Woo et al.

(10) Patent No.: US 11,191,410 B2
(45) Date of Patent: Dec. 7, 2021

(54) CLEANER

(71) Applicant: LG Electronics Inc., Seoul (KR)

(72) Inventors: Namil Woo, Seoul (KR); Ingyu Yang, Seoul (KR); Daeho Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 398 days.

(21) Appl. No.: 16/398,858

(22) Filed: Apr. 30, 2019

(65) Prior Publication Data

US 2019/0328199 A1 Oct. 31, 2019

(30) Foreign Application Priority Data

Apr. 30, 2018 (KR) ..... 10-2018-0050116

(51) Int. Cl.
*A47L 11/30* (2006.01)
*A47L 11/40* (2006.01)

(52) U.S. Cl.
CPC ..... *A47L 11/302* (2013.01); *A47L 11/408* (2013.01); *A47L 11/4016* (2013.01); *A47L 11/4069* (2013.01)

(58) Field of Classification Search
CPC ..... A47L 11/302; A47L 11/4069; A47L 11/4016; A47L 11/408; A47L 13/22; A47L 11/4083; A47L 11/4036; A47L 11/305
See application file for complete search history.

(56) References Cited

U.S. PATENT DOCUMENTS

| | | | |
|---|---|---|---|
| 3,294,664 | A | 12/1966 | Franklin |
| 2008/0282490 | A1 | 11/2008 | Oh |
| 2009/0252546 | A1 | 10/2009 | Kaleta et al. |

FOREIGN PATENT DOCUMENTS

| | | | |
|---|---|---|---|
| DE | 102008028464 | | 12/2009 |
| DE | 102016103951 | | 9/2017 |
| KR | 2001028651 | A | 4/2001 |
| KR | 10-1595727 | | 2/2016 |
| KR | 10-2018-0025795 | | 3/2018 |
| WO | WO 01/21055 | A1 | 3/2001 |

OTHER PUBLICATIONS

Germany Office Action dated Apr. 7, 2020.

*Primary Examiner* — David Redding
(74) *Attorney, Agent, or Firm* — Finnegan, Henderson, Farabow, Garrett & Dunner, LLP

(57) ABSTRACT

A cleaner includes a nozzle assembly, a cleaner body in communication with the nozzle assembly, and a damp cloth-based wiping unit coupled to the nozzle assembly. The damp cloth-based wiping unit includes a water tank. The water tank includes a storage space defined therein for storing water, an air hole defined in a top face of the water tank for receiving external air, a discharging port formed on a bottom face of the water tank for discharging the water from the storage space, and a deformable member configured to be depressed inwardly into the storage space. A damp cloth is attached to a bottom face of the water tank for receiving the water discharged through the discharging port. A pressing mechanism is configured to selectively press and translate the deformable member.

15 Claims, 10 Drawing Sheets

CLEANER

CROSS-REFERENCE TO RELATED APPLICATION

Pursuant to 35 U.S.C. § 119(a), this application claims the benefit of an earlier filing date of and the right of priority to Korean Application No. 10-2018-0050116, filed on Apr. 30, 2018, the contents of which are incorporated by reference herein in their entirety.

BACKGROUND

Field

The present disclosure relates to a vacuum cleaner with a damp cloth.

Related Art

A cleaner sucks or wipes dirt or foreign matter on a floor of a room to perform a cleaning.

Such a cleaner may be divided into a manual cleaner for a user to perform the cleaning while moving the cleaner directly, and an automated cleaner that performs the cleaning while moving on its own.

Further, the manual cleaner may be divided into a canister type cleaner, an upright type cleaner, a handy type cleaner, a stick type cleaner, and the like based on a form of the cleaner.

A wet mop tool having a water injector is disclosed in a prior art document, Korean Patent Application Publication No. 2001-0028651 (published on Apr. 6, 2001).

The wet mop tool in the prior art document includes a water case having a water injecting hole defined in a predetermined region, wherein the water case has a water injector therein, a cylindrical shaft fixed on an upper part of the water case to be rotatable, and an operation knob fixed to an upper portion of the shaft, wherein the operation knob actuates the water injector.

According to the prior art, the water injector is activated only when a user actuates the operation knob in a cleaning process. Therefore, the user has to actuate the operation knob periodically during the cleaning process, which is inconvenient.

Further, an amount of the water to be discharged when actuating the operation knob one time is predetermined. Therefore, there is a disadvantage that the number of actuations of the operation knob must be increased in order to adjust the discharge amount of water.

SUMMARY

Technical Purpose

A purpose of the present disclosure is to provide a cleaner that may simultaneously perform vacuum cleaning that vacuums foreign matters on a floor face and wiping the floor face with a damp cloth.

Further, a purpose of the present disclosure is to provide a cleaner in which water may be supplied to a damp cloth periodically during cleaning such that the damp cloth does not dry during the cleaning.

Further, a purpose of the present disclosure is to provide a cleaner in which water stored in a water tank may be periodically supplied to a damp cloth using a rotational power of a motor that rotates the damp cloth.

Further, a purpose of the present disclosure is to provide a cleaner that may periodically supply water stored in a water tank to a damp cloth, regardless of whether the damp cloth rotates.

Further, a purpose of the present disclosure is to provide a cleaner that may adjust a discharging period of water that is discharged to a damp cloth through a simple operation of pressing a button provided on a cleaner handle such that an amount of water per unit time supplied to the damp cloth may be easily changed.

Further, a purpose of the present disclosure is to provide a cleaner that may easily change whether to discharge water through a simple operation of pressing a button provided on a cleaner handle.

Further, a purpose of the present disclosure is to provide a cleaner in which a damp cloth wipes a floor face while rotating such that cleaning of the floor face may be performed more clearly.

Further, a purpose of the present disclosure is to provide a cleaner in which a thickness of a tip of a nozzle assembly where a suction nozzle is formed is slim such that cleaning of a low-height space may be easily performed.

Technical Solution

In an aspect, a cleaner includes: a nozzle assembly; a cleaner body in communication with the nozzle assembly; and a damp cloth-based wiping unit coupled to the nozzle assembly. The damp cloth-based wiping unit includes: a water tank having: a storage space defined therein for receiving water therein; an air hole defined in a top face thereof for receiving external air; a discharging port formed on a bottom face thereof for discharging the water received in the storage space; and a deformable member at least partially made of an elastic material, wherein the deformable member is configured to be depressed inwardly the storage space when an external force is applied to the deformable member; a damp cloth attached to a bottom face of the water tank for receiving the water discharged through the discharging port; and a pressing mechanism for selectively pressing the deformable member while translating relative to the deformable member.

Further, when the deformable member is deformed to be depressed inwardly the storage space by the pressing mechanism, an internal pressure of the storage space instantaneously increases such that the water is discharged through the discharging port.

Further, a size of the discharging port may be configured such that the water in the storage space is not discharged under a condition that the internal pressure of the storage space is at an atmospheric pressure.

Further, a mounting hole may be defined in the water tank. In addition, the deformable member may be coupled to the water tank to shield the mounting hole.

Further, when a pressing force of the pressing mechanism disappears in a state in which the deformable member is depressed inwardly the storage space by the pressing force of the pressing mechanism, the deformable member may be restored to an original state.

Further, the damp cloth-based wiping unit may further include a main motor for generating a rotation power and a gear module for transmitting the rotation force of the main motor. In addition, the damp cloth may be connected to the main motor or the gear module for rotation thereof.

Further, the pressing mechanism may include a first link member eccentrically and rotatably coupled to at least one gear of the gear module.

Further, the pressing mechanism may further include a second link member having one end thereof rotatably coupled to the first link member and the other end thereof coupled to the deformable member.

Further, the pressing mechanism may be connected to an auxiliary motor for generating a rotational power and to a power transmitting member for converting the rotational motion of the auxiliary motor into a translating motion and transmitting the translating motion.

Further, the cleaner body may further include a controller for controlling whether to operate the main motor or the auxiliary motor and for adjusting a rotational speed (rpm) of the main motor or the auxiliary motor.

Further, the controller may adjust a gear ratio between an input end and an output end of the gear module.

Further, the damp cloth may be disposed on a bottom face of the water tank. Further, the damp cloth may include a pair of damp cloths on both sides of the tank respectively.

Further, the discharging port may include a pair of discharging ports corresponding to the pair of damp cloths respectively and disposed on both sides of the water tank respectively.

Further, the deformable member may include a pair of deformable members corresponding to the pair of damp cloths respectively and disposed on both sides of the water tank respectively. Further, the pressing mechanism may include a pair of pressing mechanisms corresponding to the pair of damp cloths respectively and disposed on both sides of the water tank respectively.

Further, a suction nozzle may be disposed in front of the nozzle assembly. In addition, a suction passage along which air sucked into the suction nozzle flows may be formed in a space between the pair of damp cloths.

Further, the top face of the water tank may be inclined upwards rearwardly.

DESCRIPTION OF EXEMPLARY EMBODIMENTS

Hereinafter, reference will now be made in detail to embodiments described herein, examples of which are illustrated in the accompanying drawings. It should be noted that the same reference numbers will be used throughout the drawings to refer to the same or like parts. Further, in the description of the embodiment described herein, any specific description about functions or configurations that is well known in related arts will be omitted, when such a description is likely to obscure the gist of the embodiment described herein.

Further, in describing the components of the embodiment according to the present disclosure, terms such as first, second, "A", "B", (a), (b), and the like may be used. These terms are merely intended to distinguish one component from another component, and the terms do not limit the nature, sequence or order of the constituent components. It will be understood that when a component is referred to as being "connected to", or "coupled to" another component, it can be directly on, connected to, or coupled to the other component, or one or more intervening components may be present.

Further, various embodiments of a 'damp cloth' to be mentioned below may occur in terms of a material such as fabric, paper, or the like. Further, the damp cloth may mean a multi-use damp cloth that may be repeatedly used via washing, or a disposable damp cloth.

Figure 1:
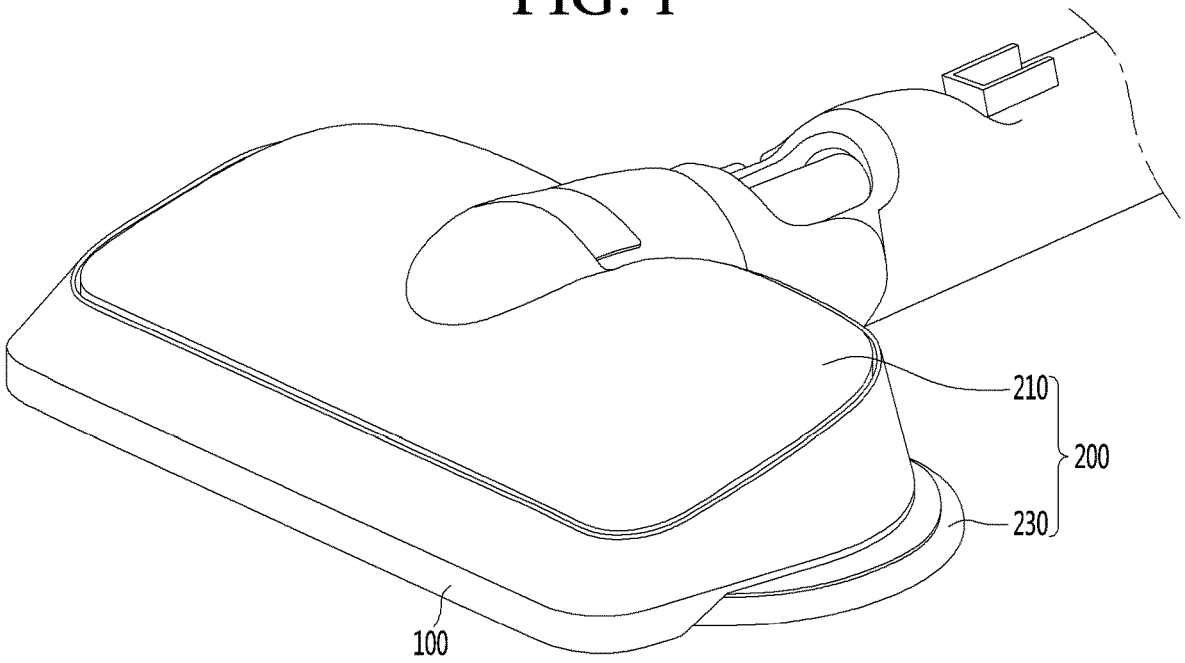
FIG. 1 is a perspective view of a nozzle assembly and a damp cloth-based wiping unit of a cleaner according to an embodiment of the present disclosure.
Figure 2:
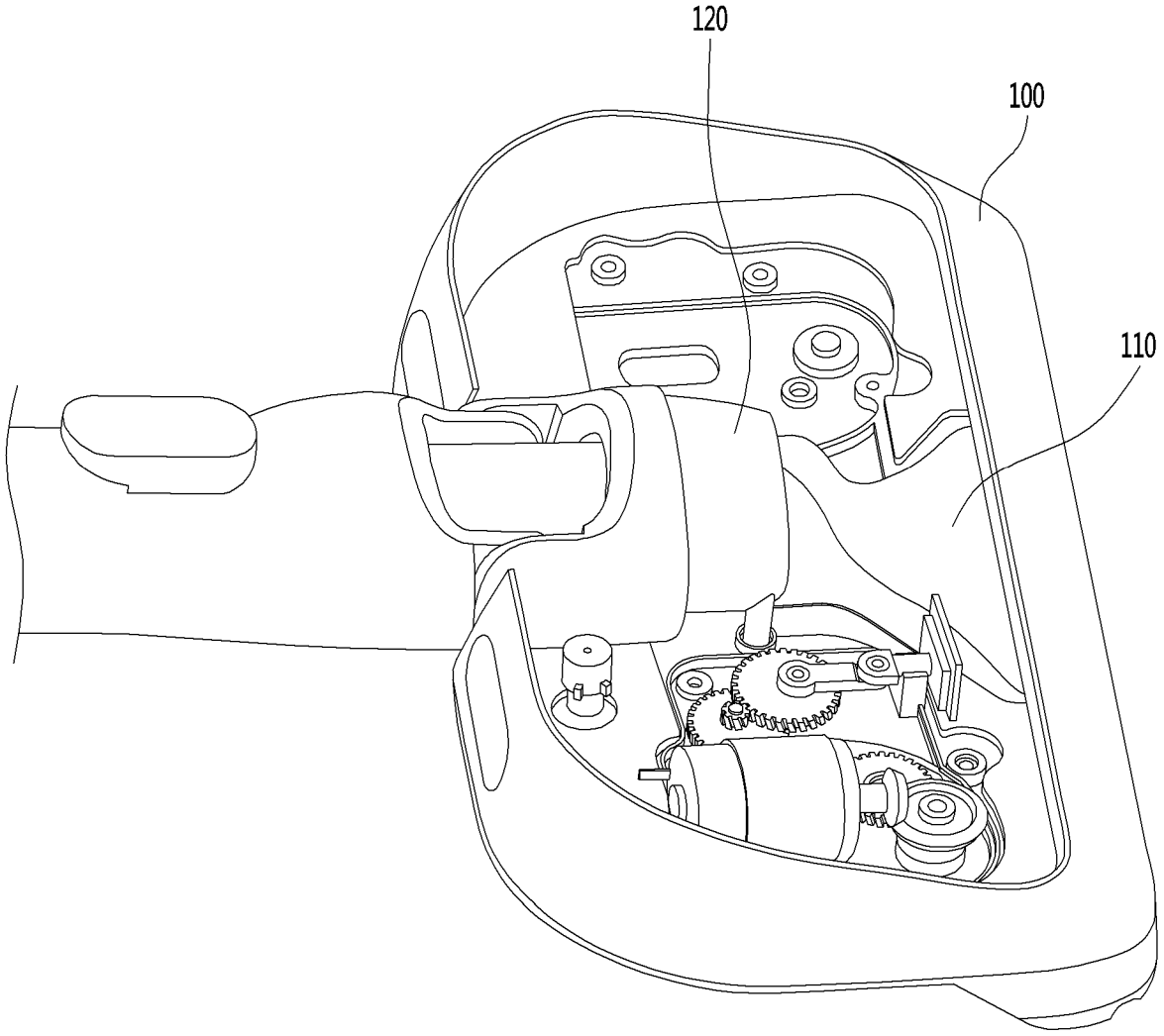
FIG. 2 is a perspective view of a water tank shown in FIG. 1 in a separated state.
Figure 3:
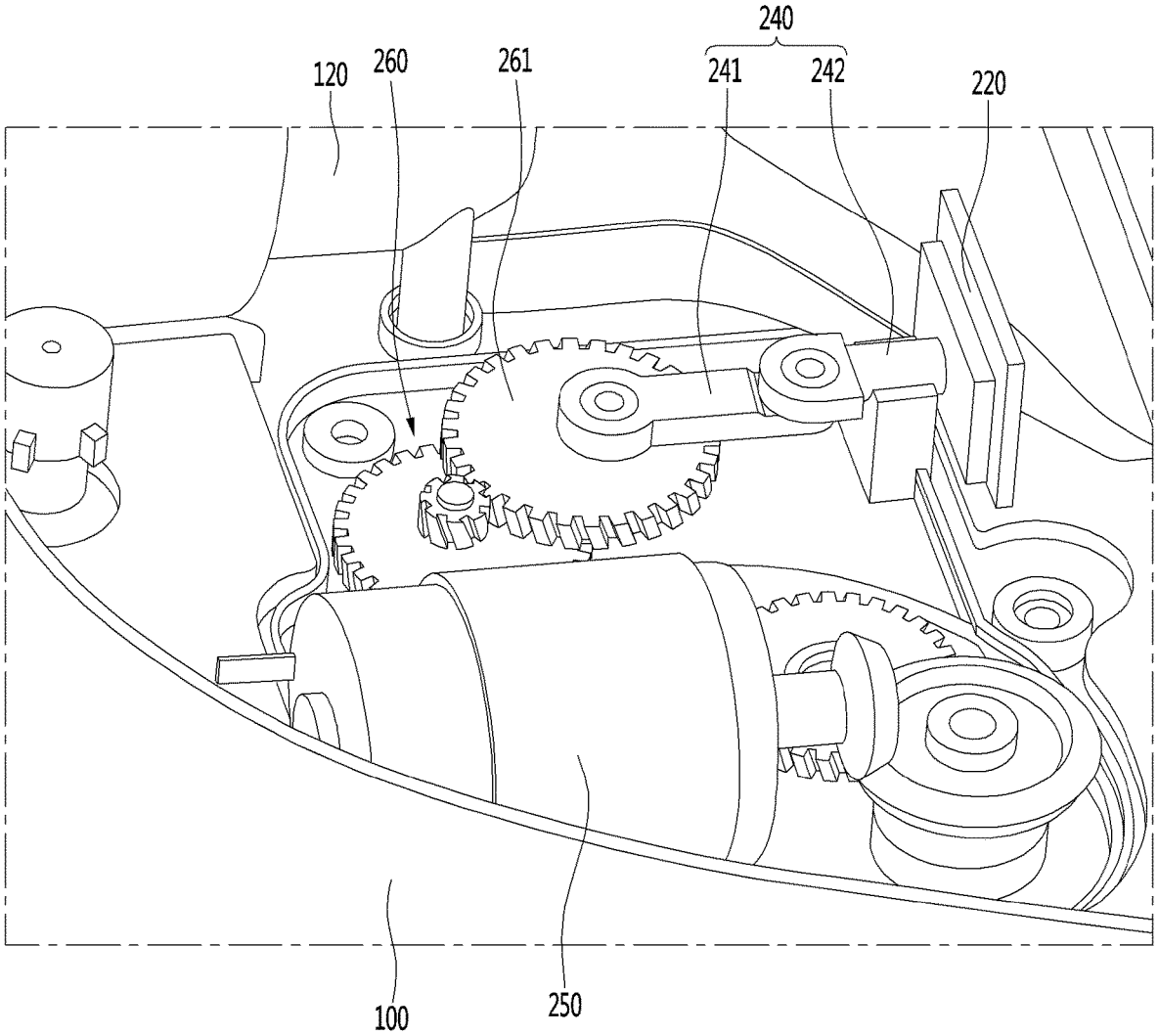
FIG. 3 is an enlarged perspective view of a portion of FIG. 2.
Figure 4:
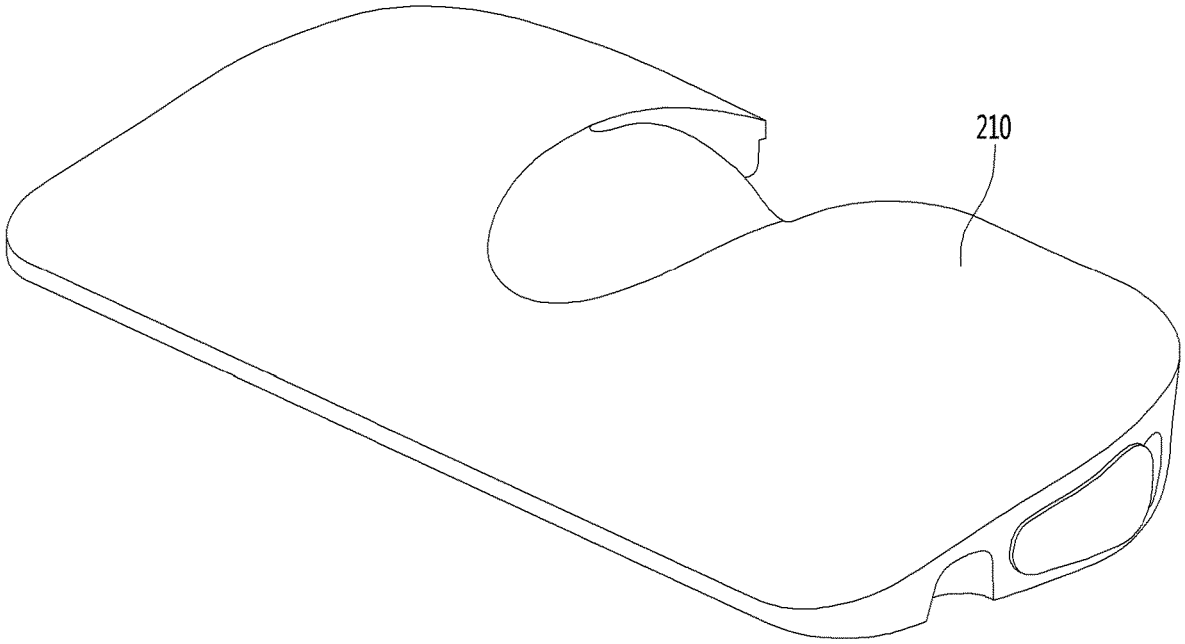
FIG. 4 is a perspective view of a water tank, which is a component of the present disclosure.
Figure 5:
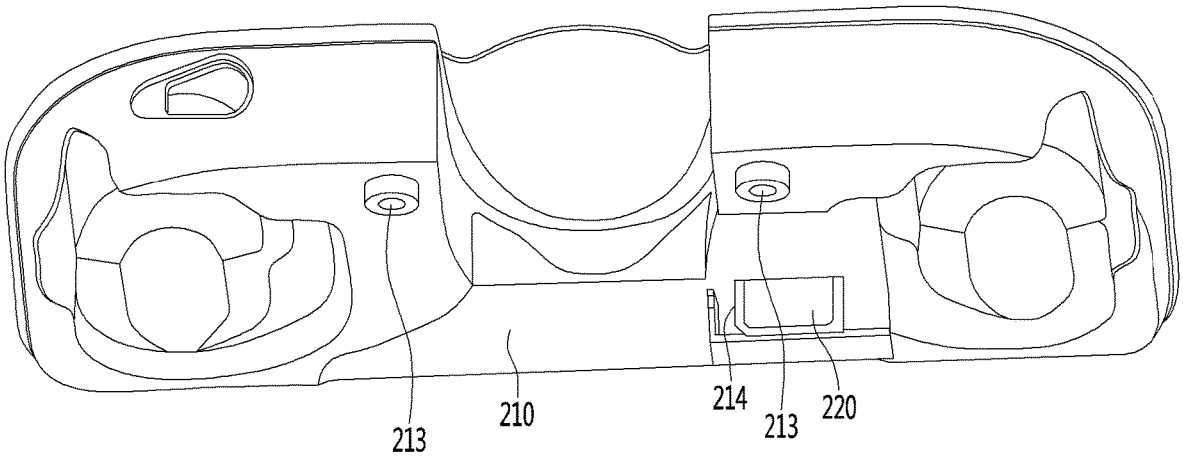
FIG. 5 is a bottom perspective view of a water tank, which is a component of the present disclosure.

FIG. 1 is a perspective view of a nozzle assembly and a damp cloth-based wiping unit of a cleaner according to an embodiment of the present disclosure. In addition, FIG. 2 is a perspective view of a water tank shown in FIG. 1 in a separated state. In addition, FIG. 3 is an enlarged perspective view of a portion of FIG. 2. In addition, FIG. 4 is a perspective view of a water tank, which is a component of the present disclosure. In addition, FIG. 5 is a bottom perspective view of a water tank, which is a component of the present disclosure.

With reference to FIGS. 1 to 5, a cleaner according to the present disclosure includes a cleaner body (not shown) and a cleaning module connected to the cleaner body.

According to the present disclosure, the cleaning module may include a first cleaning module and a second cleaning module.

First, the first cleaning module may include a suction fan and a nozzle assembly 100 to perform vacuum cleaning on a floor face. Further, the first cleaning module may include a brush for sweeping the floor, and further, the brush may be rotatably provided.

Further, the second cleaning module may include a damp cloth-based wiping unit 200, and may be provided to wipe the floor face while in contact with the floor face. In this embodiment, the damp cloth-based wiping unit 200 moves together with the nozzle assembly 100 to wipe the floor face. In this connection, the damp cloth-based wiping unit 200 may be provided to wipe the floor face while rotating.

The damp cloth-based wiping unit 200 may be coupled to the nozzle assembly 100.

Hereinafter, the damp cloth-based wiping unit 200 and the nozzle assembly 100 will be described in more detail.

The damp cloth-based wiping unit 200 includes a water tank 210, a damp cloth 230, and a pressing mechanism 240.

The water tank 210 defines a storage space 211 therein for receiving water therein, and defines, in a top face thereof, an air hole 212 for receiving external air. In addition, the water tank 210 forms, on a bottom face thereof, a discharging port 213 for discharging the water received in the storage space. A deformable member 220, at least partially made of an elastic material and configured to be depressed inwardly the storage space when an external force is applied to the deformable member 220, is formed on one side of the water tank 210.

The damp cloth 230 wipes the floor face while in contact with the floor face. Further, the damp cloth 230 is attached to the bottom face of the water tank 210 and receives the water discharged through the discharging port 213.

In this connection, the water in the storage space 211 may be discharged through the discharging port 213 while the external air is flowed into the storage space 211 through the air hole 212.

Further, the pressing mechanism 240 is provided to selectively press the deformable member 220 while translating in a direction intersecting the deformable member 220 from the outside of the water tank 210.

In a case of the damp cloth-based wiping unit 200 as described above, the deformable member 220 may be deformed to be depressed inwardly the storage space 211 by a pressing force generated while the pressing mechanism 240 translates. In this case, as internal volume of the storage space 211 is reduced, and accordingly, internal pressure of the storage space 211 increases instantaneously, the water stored in the storage space 211 is discharged through the discharging port 213. Then, the water discharged through the discharging port 213 may be supplied to the damp cloth 230.

The damp cloth 230 may be wetted through the process as described above, and may wipe the floor face.

Further, when wiping the floor face, the damp cloth 230 is drained and dried. When the damp cloth 230 is dried as described above, the wiping of the floor face may not be proceeded properly.

According to the present disclosure, the pressing mechanism 240 periodically presses the deformable member 220, and consequently the water stored in the storage space 211 is periodically discharged to the damp cloth 230 through the discharging port 213. Accordingly, the damp cloth 230 may be kept wet, and the wiping of the floor face may be continuously performed.

The pressing mechanism 240 may be driven in a motorized manner. In one example, the pressing mechanism 240 may be connected to a power source provided for rotating the damp cloth 230 and periodically press the deformable member 220 while translating.

In another example, the pressing mechanism 240 may be connected to a separate power source and periodically press the deformable member 220 while translating.

Various embodiments of the pressing mechanism 240 may occur within an extent that the pressing mechanism 240 may reciprocate linearly.

In one example, the pressing mechanism 240 may be constituted by a motor generating a rotational power, and a power transmitting member such as a link, a cam, a gear, a ball screw, and the like for converting a rotational motion of the motor into a translating motion.

In another example, the pressing mechanism 240 may be provided as a linear motor.

In addition, various embodiments of the pressing mechanism 240 may occur such that the pressing mechanism 240 may periodically press the deformable member 220 while translating.

In a situation in which the discharging of the water is unnecessary, some of the water stored in the storage space 211 may leak through the discharging port 213.

In order to prevent this, a size of the discharging port 213 may be configured such that the water in the storage space 211 is not discharged under a condition that the internal pressure of the storage space 211 is at an atmospheric pressure.

Further, the size of the discharging port 213 may be configured such that the water in the storage space 211 is discharged under a condition that the internal pressure of the storage space 211 is greater than the atmospheric pressure.

According to this configuration, only when the pressing mechanism 240 presses the deformable member 220 and thus at least the portion of the deformable member 220 is deformed to be depressed inwardly the storage space 211, and therefore, the volume of the storage space 211 is reduced, and thus, the internal pressure thereof increases instantaneously, the water in the storage space 211 may be discharged through the discharging port 213.

On the other hand, when the pressing mechanism 240 does not press the deformable member 220 (atmospheric pressure state), the water in the storage space 211 is not discharged through the discharging port 213 but remains stored in the storage space 211.

Further, a mounting hole 214 is defined in the water tank 210. The deformable member 220 is coupled to the water tank 210 to shield the mounting hole 214. In this connection, even when the deformable member 220 is pressed, the deformable member 220 and the mounting hole 214 may be kept in a sealed state such that leakage does not occur.

Further, the deformable member 220 may be made of an elastic material such as rubber, silicone, or the like. When the pressing force of the pressing mechanism 240 disappears in a state in which the deformable member 220 is depressed inwardly the storage space 211 by the pressing force of the pressing mechanism 240, the deformable member 220 may be restored to an original state.

In one example, the mounting hole 214 may be defined in a rectangular shape. Further, the deformable member 220 may be formed in a rectangular plate shape.

Thus, when the pressing mechanism 240 presses the deformable member 220, the deformable member 220 in a planar shape is deformed to be depressed inwardly the water tank 210. Further, when the pressing force of the pressing mechanism 240 disappears, the deformable member 220 is restored to the planar shape.

Further, the deformable member 220 may be integrally coupled with an end of the pressing mechanism 240.

Further, the deformable member 220 may be provided separately from the pressing mechanism 240, and then may be in contact with each other.

Further, the damp cloth-based wiping unit 200 may further include a main motor 250 for generating the rotation power and a gear module 260 for transmitting the rotation force of the main motor 250. Further, the damp cloth 230 is connected to the gear module 260 for rotation thereof.

In one example, the damp cloth 230 may include a plurality of damp cloths. Further, the main motor 250 may also include a plurality of main motors. The plurality of main motors may be respectively coupled to the plurality of damp cloths.

Further, the damp cloth 230 may not be connected to the gear module 260, but may be directly connected to the main motor 250.

When the damp cloth 230 and the main motor 250 are connected as described above, the damp cloth 230 may wipe the floor face while being rotated by the main motor 250.

Figure 6:
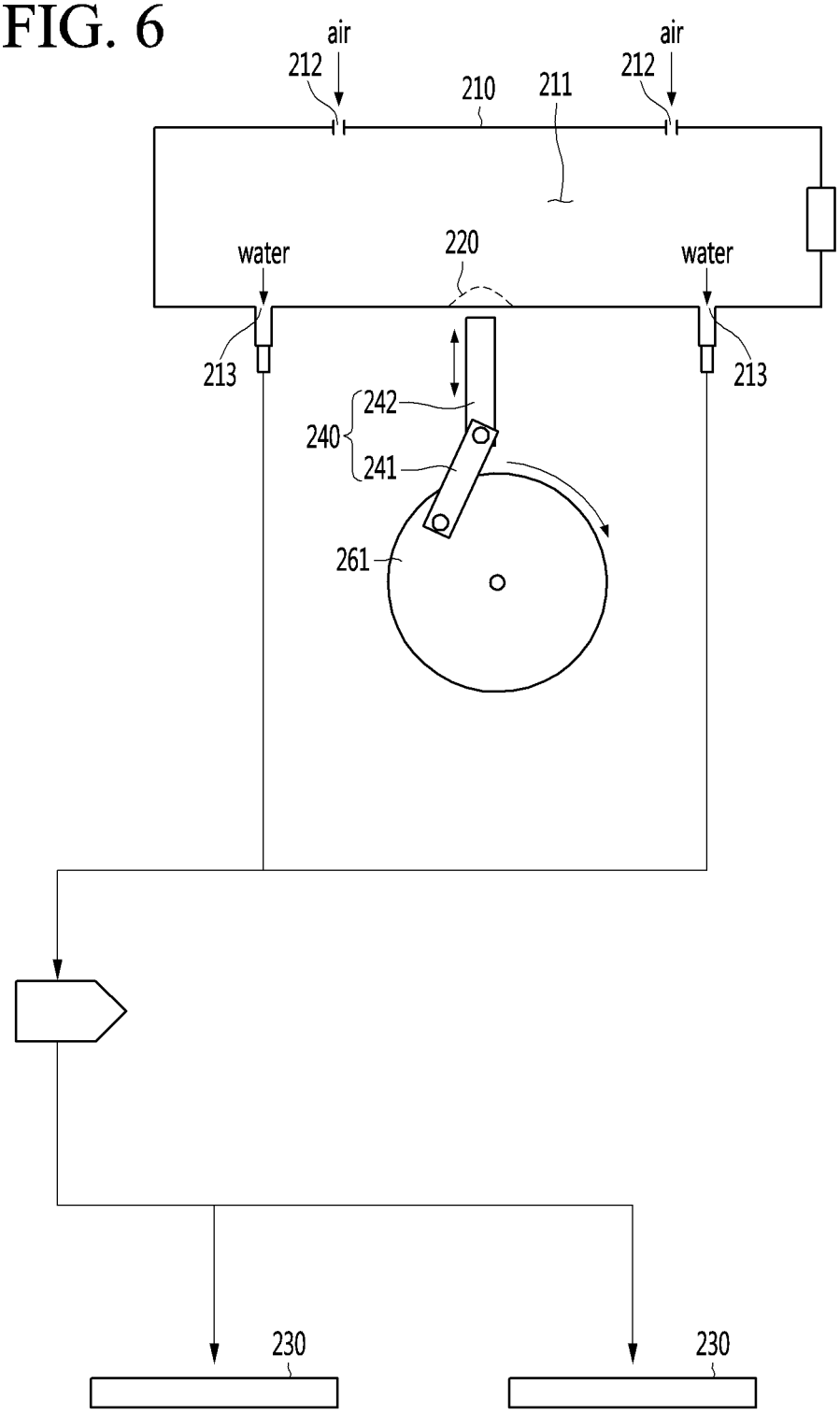
FIG. 6 is a schematic perspective view of a configuration of a damp cloth-based wiping unit, a component of the present disclosure.
Figure 7:
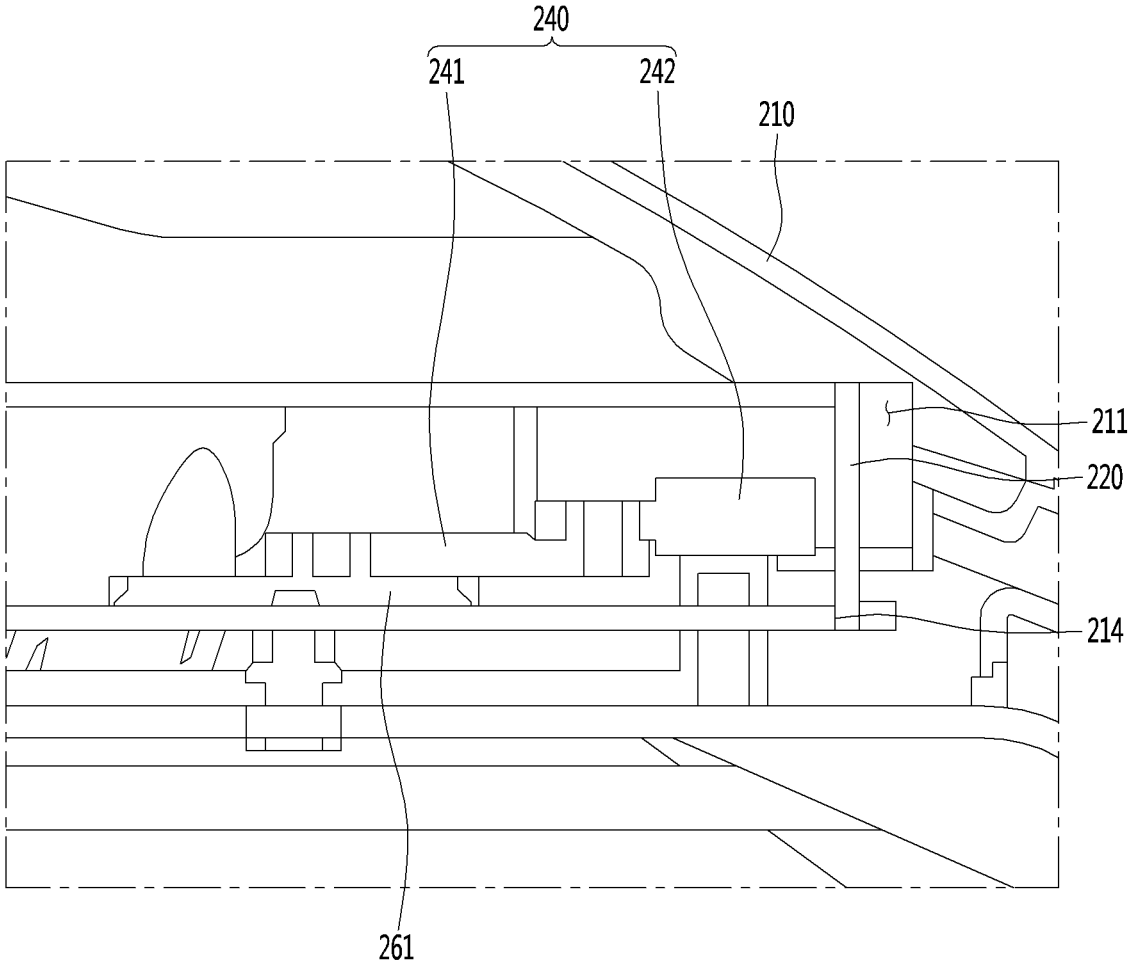
FIG. 7 illustrates a cross section of a water tank with no external force applied to a deformable member.
Figure 8:
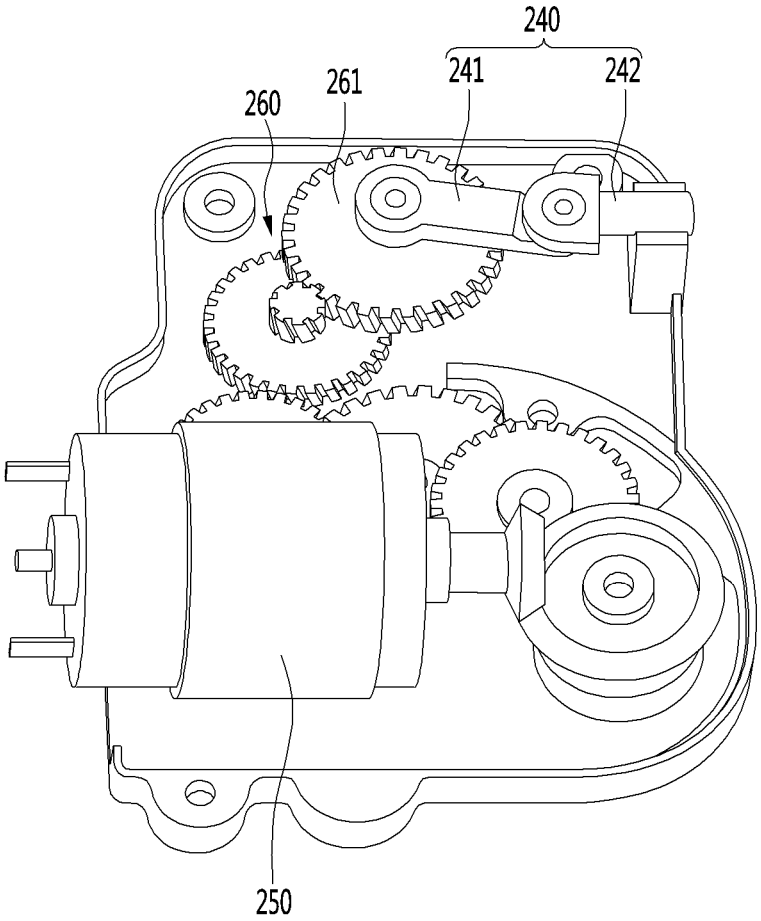
FIG. 8 is a perspective view illustrating a state of a pressing mechanism when a deformable member is not pressurized.
Figure 9:
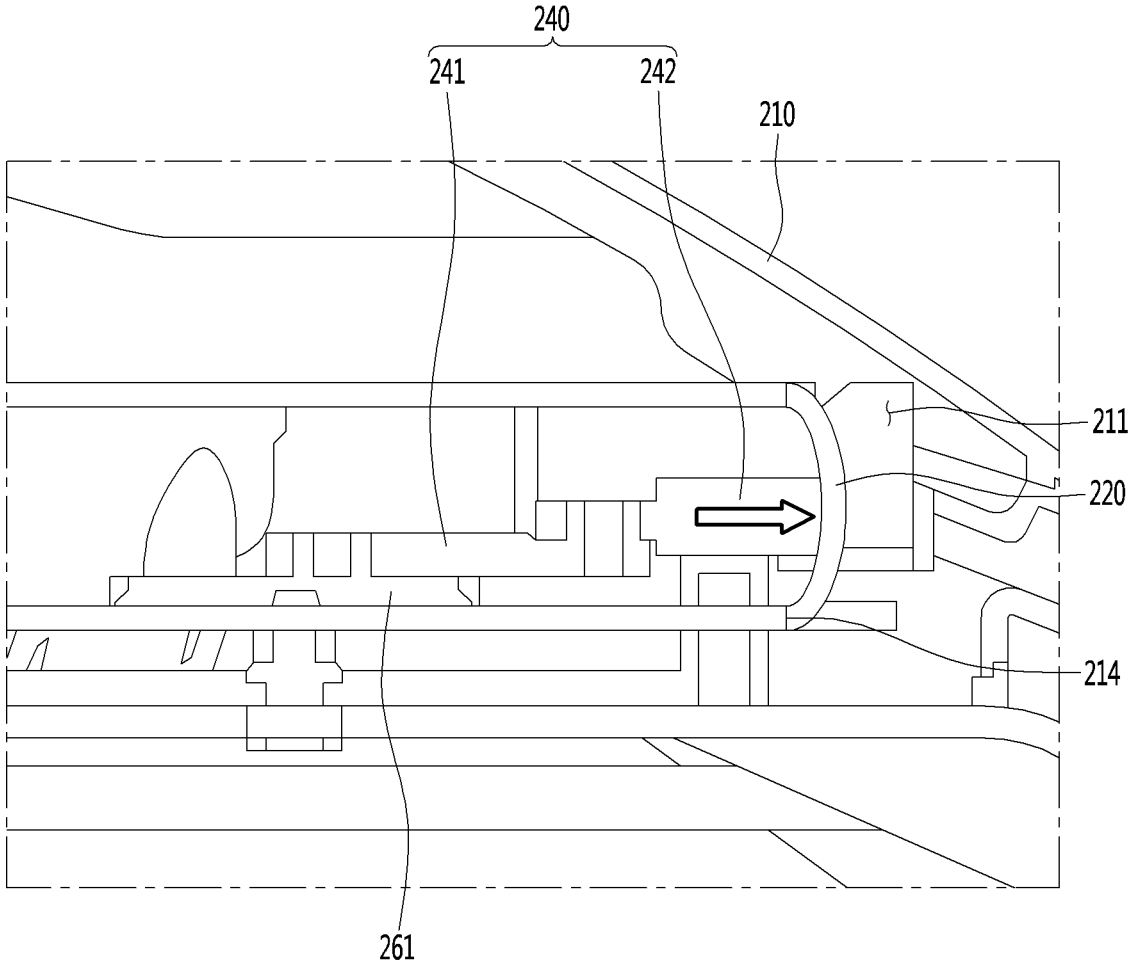
FIG. 9 illustrates a cross section of a water tank with an external force applied to a deformable member.
Figure 10:
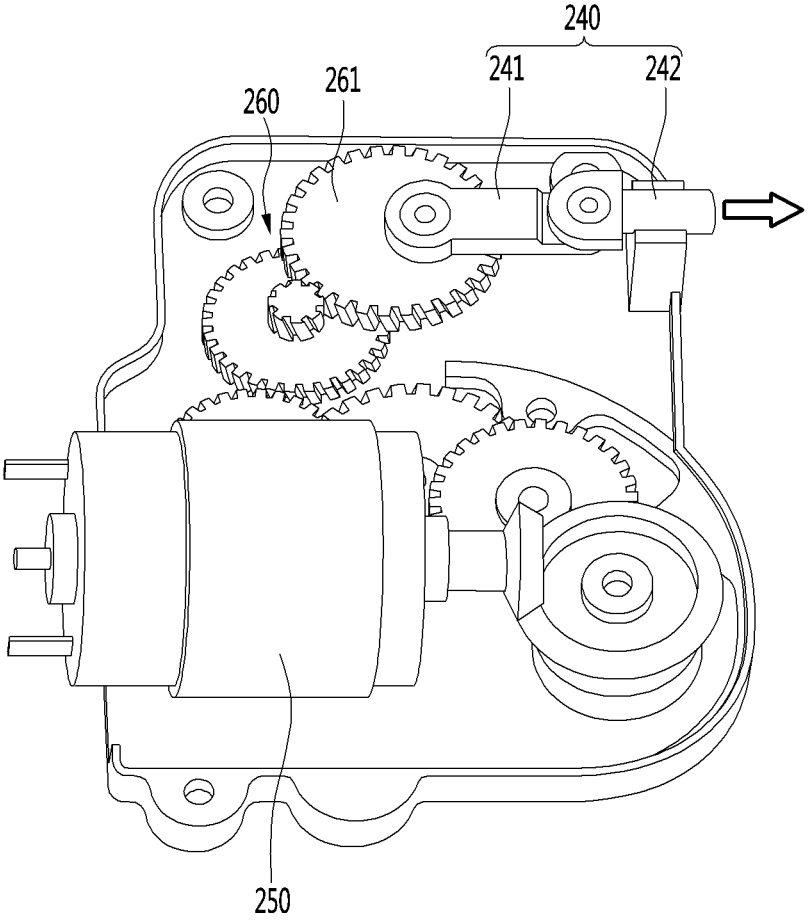
FIG. 10 is a perspective view illustrating a state of a pressing mechanism when a deformable member is pressed.

FIG. 6 is a schematic perspective view of a configuration of a damp cloth-based wiping unit, a component of the present disclosure. In addition, FIG. 7 illustrates a cross section of a water tank with no external force applied to a deformable member. In addition, FIG. 8 is a perspective view illustrating a state of a pressing mechanism when a deformable member is not pressurized. In addition, FIG. 9 illustrates a cross section of a water tank with an external force applied to a deformable member. In addition, FIG. 10 is a perspective view illustrating a state of a pressing mechanism when a deformable member is pressed.

With reference to FIGS. 6 to 10, the pressing mechanism 240 may receive the rotational power of the main motor 250 and reciprocate.

For this purpose, the pressing mechanism 240 may further include a first link member 241 eccentrically and rotatably coupled to at least one gear 261 of the gear module 260 and a second link member 242 having one end thereof rotatably coupled to the first link member 241 and the other end thereof coupled to the deformable member 220.

Again, with reference to FIG. 6, the gear 261 rotates in association with the main motor 250. In this connection, one end of the first link member 241, which is eccentrically and is rotatably connected to the gear 261, rotates together with the gear 261 in a circle.

Further, the second link member 242 connected to the other end of the first link member 241 translates by the first link member 241.

In this process, the deformable member 220 connected to the other end of the second link member 242 may be pressed at regular intervals.

Referring to FIG. 6, when the first link member 241 rotates from a lowermost position to an uppermost position, the other end of the second link member 242 presses the deformable member 220. Then, when the first link member 241 rotates from the uppermost position to the lowermost position, the pressing force of the second link member 242 applied to the deformable member 220 disappears, and the deformable member 220 may be restored to its original state.

That is, in the above example, the main motor 250 rotates the damp cloth 230 and translates the pressing mechanism 240, at the same time.

In another example, the pressing mechanism 240 may be connected to an auxiliary motor (not shown) for generating the rotational power and the power transmitting member (not shown) for converting a rotational motion of the auxiliary motor (not shown) into a translating motion and transmitting the translating motion.

In this case, the pressing mechanism 240 is not be connected to the main motor 250 that rotates the damp cloth 230 but rotates in connection with the separate auxiliary motor (not shown).

In this case, the separate auxiliary motor (not shown) is provided to translate the pressing mechanism 240 such that the operation of the pressing mechanism 240 is possible irrespective of whether the damp cloth 230 is rotated or not.

When the auxiliary motor (not shown) provided separately from the main motor 250 is rotated, the power transmitting member (not shown) converts the rotational motion of the auxiliary motor into a linear translating motion and transmits the linear translating motion of the main motor 250 to the pressing mechanism 240.

Thereafter, the pressing mechanism 240 presses the deformable member 220 periodically.

Further, the cleaner body (not shown) may further include a controller (not shown) for controlling whether to operate the main motor 250 or the auxiliary motor (not shown) and for adjusting a rotational speed (rpm) of the main motor 250 or the auxiliary motor (not shown).

In one example, the controller (not shown) may be formed on a handle portion of the cleaner body (not shown). The controller (not shown) may include a power button (on/off button) of the main motor 250 or the auxiliary motor (not shown) and a rotational speed adjust button (intensity button) of the main motor 250 or the auxiliary motor (not shown).

In particular, the controller (not shown) may be formed at a position adjacent to buttons for controlling overall operations of the cleaner.

When the controller as described above is provided, a rotational speed of the damp cloth 230 connected to the main motor 250 may be adjusted by adjusting the rotational speed of the main motor 250.

Further, a rotational speed of the gear unit 260 connected to the main motor 250 may be adjusted by adjusting the rotational speed of the main motor 250. A translating speed of the pressing mechanism 240 mounted on the gear unit 260 may also be adjusted.

In one example, when the rotational speed of the main motor 250 is increased, the translating motion of the pressing mechanism 240 may be accelerated. In addition, the number of times the water is discharged per unit time from the water tank 210 to the discharging port 213 is increased, and as a result, a water discharged amount per unit time may be increased.

Further, when the rotation speed of the main motor 250 is slowed, the translating motion of the pressing mechanism 240 may also be slowed down. In addition, the number of times the water is discharged per unit time from the water tank 210 to the discharging port 213 is reduced, and as a result, the water discharged amount per unit time may be reduced.

Further, the controller may adjust a gear ratio between the input and output ends of the gear module 260.

In this case, the controller adjusts the gear ratio between the input and output ends of the gear module 260 with the rotational speed of the main motor 250 kept constant. Consequently, the translating speed of the pressing mechanism 240 connected to the gear module 260 may be adjusted.

In another example, when the controller is provided as described above, the rotational speed of the auxiliary motor (not shown) may be adjusted such that translating speeds of the power transmitting member (not shown) and the pressing mechanism 240 connected to the auxiliary motor (not shown) may be adjusted.

Further, the damp cloth 230 may be disposed on the bottom face of the water tank 210, and may include a pair of damp cloths on both sides of the tank respectively.

Further, the damp cloth 230 may be connected to the main motor 250 to wipe the floor face while rotating.

Further, the discharging port 213 may include a pair of discharging ports corresponding to the pair of damp cloths respectively and disposed on both sides of the water tank 210. Thus, the water may be discharged from the discharging ports formed on both sides of the water tank 210 such that the water may be uniformly supplied to each of the damp cloths.

Further, the deformable member 220 may include a pair of deformable members corresponding to the pair of damp cloths respectively and disposed on both sides of the water tank respectively. In addition, the pressing mechanism 240 may include a pair of pressing mechanisms corresponding to the pair of damp cloths respectively and disposed on both sides of the water tank respectively.

Further, the main motor 250 may include a pair of main motors, and the pair of main motors may be connected to the pair of damp cloths respectively.

When the main motors 250 includes the pair of main motors as described above, the pair of main motors may be disposed on both sides. Thus, a center of gravity of the nozzle assembly 100 may be located in a center of the nozzle assembly 100. Further, when the pair of main motors are disposed on both sides, a space may be secured between the damp cloth 230 and the main motor 250, and a suction passage 120 to be described below may be disposed in the secured space. Further, when the pair of main motors are disposed on both sides, the rotation of the damp cloths may be performed uniformly on both sides.

Further, a suction nozzle 110 is formed in front of the nozzle assembly 100, and a suction passage 120 along which an air sucked into the suction nozzle 110 flows is formed in the space between the pair of damp cloths.

Thus, primary cleaning of the floor face is performed while the suction nozzle 110 located at a tip of the nozzle assembly 100 sucks dust and the like on the floor face. Thereafter, secondary cleaning of the floor face is performed while the damp cloths disposed on both rear sides of the suction nozzle 110 wipe the floor face.

In this connection, the suction passage 120 is disposed between the damp cloths. Foreign matters such as dust, and the like, which are sucked through the suction nozzle 110, may pass through the suction passage 120 to be collected into a dust container of the cleaner body (not shown).

Further, the top face of the water tank 210 is inclined upwards rearwardly. That is, a height of a front is formed lower than a height of a rear, and the front is formed slim.

In this connection, the front means the tip of the nozzle assembly 100 in which the suction nozzle 110 is formed. As described above, when the top face of the water tank 210 is inclined upwards rearwardly, and when the cleaning of the floor face is performed using the nozzle assembly 100, the tip of the nozzle assembly 100, which is slimly formed, may be inserted into a low-height space such as under furniture, under a sofa, under a bed, and the like. Thus, cleaning of the low-height space may be performed.

In order to further reduce a height of the tip of the nozzle assembly 100, parts such as the above-described main motor 250, and the like are disposed at the rear of the nozzle assembly 100 rather than the front.

Hereinafter, with reference to FIGS. 7 to 10, a process of discharging the water from the damp cloth-based wiping unit of the cleaner according to the present disclosure will be described.

First, FIGS. 7 and 8 illustrate a state in which the pressing mechanism 240 does not press the deformable member 220.

With reference to the drawings, the deformable member 220 maintains the planar shape in a state in which the pressing mechanism 240 does not press the deformable member 220.

In this state, when the main motor 250 rotates and the gear unit 260 connected to the main motor 250 rotates, the first link member 241 connected to the gear 261 rotates and the second link member 242 moves toward the deformable member 220 to press the deformable member 220.

FIGS. 9 and 10 illustrate a state in which the pressing mechanism 240 presses the deformable member 220.

With reference to the drawings, when the pressing mechanism 240 presses the deformable member 220 in a process of translating, the deformable member 220 is deformed to be depressed inwardly the storage space 211.

In this connection, the internal volume of the storage space 211 is reduced, and thus the internal pressure of the storage space 211 instantaneously increases such that the water stored in the storage space 211 is discharged through the discharging port 213. Then, the water discharged through the discharging port 213 is supplied to the damp cloth 230.

In this state, when the main motor 250 continuously rotates and the gear unit 260 connected to the main motor 250 rotates, the first link member 241 connected to the gear 261 rotates, and the second link member 242 moves to an opposite side of the deformable member 220. Accordingly, the pressing force applied to the deformable member 220 disappears, and the deformable member 220 may be restored to the original state shown in FIG. 7.

When the main motor 250 rotates as described above, the pressing mechanism 240 presses the deformable member 220 periodically, as described above. Accordingly, the water in the storage space 211 may be periodically supplied to the damp cloth 230 through the discharging port 213.

Further, according to the present disclosure, the cleaning of the floor face through the air suction and the wiping of the floor face with the damp cloth may be performed at the same time such that the cleaning of the floor face may be performed more clearly. Further, the water may be supplied to the damp cloth periodically during the cleaning such that the damp cloth does not dry during the wiping with the damp cloth. Thus, an efficiency of the cleaning may be improved, and convenience of the user may be improved. Further, the water stored in the water tank may be periodically supplied to the damp cloth using the rotational power of the motor that rotates the damp cloth. Further, the water stored in a water tank may be provided to the damp cloth periodically, regardless of whether the damp cloth rotates. Further, a discharging period of the water that is discharged to the damp cloth is adjusted through a simple operation of pressing a button provided on the cleaner handle such that an amount of the water per unit time supplied to the damp cloth may be easily changed. Further, a thickness of the tip of the nozzle assembly where the suction nozzle is formed is slim such that the cleaning of the low-height space may be easily performed.

Although all of the components that constituting the embodiments of the present disclosure have been described as being combined together or operated in combination, the present disclosure is not necessarily limited to these embodiments. That is, within the scope of the present disclosure, all of the components may operate selectively in one or more combinations. Further, as used herein, the singular forms "a," "an," and "the" are intended to include the plural forms as well, unless the context clearly indicates otherwise. It will be further understood that the terms "comprises," "comprising," "includes," and "including," when used in the present application, specify the presence of the stated features, steps, operations, elements, components, and/or combinations thereof, but do not preclude the presence or addition of one or more other features, steps, operations, elements, components, and/or combinations thereof.

Therefore, the exemplary embodiments of the present disclosure are provided to explain the spirit and scope of the present disclosure, but not to limit them, so that the spirit and scope of the present disclosure is not limited by the embodiments. The scope of the present disclosure should be construed on the basis of the accompanying claims, and all the technical ideas within the scope equivalent to the claims should be included in the scope of the present disclosure.

What is claimed is:

1. A cleaner comprising:

a nozzle assembly; a cleaner body in communication with the nozzle assembly; and a damp cloth-based wiping unit coupled to the nozzle assembly, wherein the damp cloth-based wiping unit includes:

a water tank having:

a storage space defined in the water tank for storing water;

an air hole defined in a top face of the water tank for receiving external air;

a discharging port formed on a bottom face of the water tank for discharging water from the storage space; and a deformable member at least partially made of an elastic material, wherein the deformable member is configured to be depressed inwardly into the storage space when an external force is applied to the deformable member;

a damp cloth attached to a bottom face of the water tank for receiving the water discharged through the discharging port; and a pressing mechanism for selectively pressing the deformable member while translating the pressing mechanism relative to the deformable member, wherein when the deformable member is deformed and depressed inwardly into the storage space by the pressing mechanism, an internal pressure of the storage space is increased such that the water is discharged through the discharging port.

2. The cleaner of claim 1, wherein a size of the discharging port is configured such that the water in the storage space is not discharged when the internal pressure of the storage space is at an atmospheric pressure.

3. The cleaner of claim 1, wherein a mounting hole is defined in the water tank and the deformable member is coupled to the water tank to shield the mounting hole.

4. The cleaner of claim 1, wherein, release of a pressing force of the pressing mechanism when the deformable member is depressed inwardly into the storage space by the pressing force of the pressing mechanism results in the deformable member being restored to an original state.

5. The cleaner of claim 1, wherein the damp cloth-based wiping unit further includes a main motor for generating a rotation power and a gear module for transmitting the rotation power of the main motor, wherein the damp cloth is connected to one of the main motor or the gear module for rotation of the damp cloth.

6. The cleaner of claim 5, wherein the pressing mechanism includes a first link member eccentrically and rotatably coupled to at least one gear of the gear module.

7. The cleaner of claim 6, wherein the pressing mechanism further includes a second link member having one end of the second link member rotatably coupled to the first link member and the other end of the second link member coupled to the deformable member.

8. The cleaner of claim 1, wherein the pressing mechanism is connected to an auxiliary motor for generating a rotational power and to a power transmitting member for converting rotational motion of the auxiliary motor into a translating motion and transmitting the translating motion.

9. The cleaner of claim 8, wherein the cleaner body further includes a controller configured to determine whether to operate the main motor or the auxiliary motor and configured for adjusting a rotational speed (rpm) of the main motor or the auxiliary motor.

10. The cleaner of claim 9, wherein the controller is configured to adjust a gear ratio between an input end and an output end of a gear module configured for transmitting the rotation power of the main motor.

11. The cleaner of claim 1, wherein the damp cloth is disposed on a bottom face of the water tank the damp cloth including a pair of damp cloths on both sides of the tank respectively.

12. The cleaner of claim 11, wherein the discharging port includes a pair of discharging ports corresponding to the pair of damp cloths respectively and disposed on both sides of the water tank respectively.

13. The cleaner of claim 11, wherein the deformable member includes a pair of deformable members corresponding to the pair of damp cloths respectively and disposed on both sides of the water tank respectively, and wherein the pressing mechanism includes a pair of pressing mechanisms corresponding to the pair of damp cloths respectively and disposed on both sides of the water tank respectively.

14. The cleaner of claim 11, wherein a suction nozzle is disposed in front of the nozzle assembly, and wherein a suction passage through which air is sucked into the suction nozzle is formed in a space between the pair of damp cloths.

15. The cleaner of claim 14, wherein the top face of the water tank is inclined upwards rearwardly.

* * * * *